US010517339B1

(12) United States Patent
Baxter

(10) Patent No.: US 10,517,339 B1
(45) Date of Patent: Dec. 31, 2019

(54) PERSPIRATION DIVERTING HEADBAND

(71) Applicant: David Baxter, Frisco, TX (US)

(72) Inventor: David Baxter, Frisco, TX (US)

( * ) Notice: Subject to any disclaimer, the term of this patent is extended or adjusted under 35 U.S.C. 154(b) by 191 days.

(21) Appl. No.: 14/689,278

(22) Filed: Apr. 17, 2015

Related U.S. Application Data

(60) Provisional application No. 61/980,633, filed on Apr. 17, 2014.

(51) Int. Cl.
*A41D 20/00* (2006.01)
*A41D 13/00* (2006.01)

(52) U.S. Cl.
CPC ..... *A41D 20/00* (2013.01); *A41D 13/00* (2013.01)

(58) Field of Classification Search
CPC ..... A41D 20/00; A41D 20/005; A41D 13/00; A41D 2023/008; A41D 2023/004; A61F 2007/0007; A61F 9/027; A42C 5/02; G02C 3/003; Y10S 2/11; A44C 5/00; A45D 8/00; A44B 19/262
USPC ..... 2/DIG. 11, 181, 174, 162, 171.8, 181.4, 2/436, 171.2, 181.6, 195.1, 195.3, 183; 132/273
See application file for complete search history.

(56) References Cited

U.S. PATENT DOCUMENTS 5,146,630 A 9/1992 Richard
5,718,001 A * 2/1998 Wright ..... A45D 44/12 128/864
5,740,556 A * 4/1998 Brown ..... A41D 20/00 2/181
5,781,932 A * 7/1998 Brown ..... A41D 20/00 2/181
5,848,981 A * 12/1998 Herbranson ..... A61F 7/10 601/134
6,058,578 A * 5/2000 Lan ..... A44B 19/262 24/115 G
6,298,493 B1 * 10/2001 Ambroise ..... A45D 44/12 128/866
6,675,446 B2 * 1/2004 Buettell ..... G09F 21/02 24/115 H
6,880,364 B1 * 4/2005 Vidolin ..... A44C 5/025 40/633
7,398,559 B2 7/2008 Flatt
2002/0120976 A1 * 9/2002 Cannings ..... A45D 8/36 2/171

(Continued)

*Primary Examiner* — Nathan E Durham
*Assistant Examiner* — Abby M Spatz
(74) *Attorney, Agent, or Firm* — Law Office of Sam Sokhansanj PLLC

(57) ABSTRACT

A perspiration diverting headband is provided having a flexible tubing having a first and second end, an elastic band, wherein the band is disposed within the tubing, a first connector coupled to a first end of the tubing, and a second connector coupled to a second end of the tubing, wherein the first and second connector secure the elastic band and tubing, and a slidable tension fastener configured to secure the elastic band. In addition, the tubing can be flexible tubing that is cylindrical in cross-section. Further, the flexible tubing can be configured to divert perspiration fluids away from a forehead region to a temple region of a user's head. Further, the headband can be simple to use and adjust, simple to manufacture, made of light weight moisture resistant and anti-microbial material, hygienic, and can be customized and configured to any shape, color, or design.

6 Claims, 4 Drawing Sheets

(56) References Cited

U.S. PATENT DOCUMENTS

2009/0323018 A1* 12/2009 Pettingill ..... G02C 3/003
351/157
2010/0236287 A1* 9/2010 Summerford ..... A44C 15/005
63/1.12

* cited by examiner

PERSPIRATION DIVERTING HEADBAND

CROSS-REFERENCE TO RELATED APPLICATION

This application claims the benefit of U.S. Provisional Application No. 61/980,633 filed on Apr. 17, 2014, which is incorporated herein by reference in its entirety.

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

Generally, when a person perspires, their perspiration fluids from the person's forehead and flows downward and often flows into the person's eyes. To overcome this problem, there are currently numerous headbands that can absorb the perspiration on the forehead before it can flow into one's eyes. In this respect, throughout the years, a number of innovations have been developed relating to perspiration absorbent headbands. One problem associated with any headband that absorbs perspiration is the problem of saturation. When the headband becomes saturated with perspiration, it can no longer absorb perspiration. As a result, either the wearer must take the headband off and squeeze out the absorbed perspiration, or excess perspiration will flow out from the saturated absorbent.

Hence, what is needed is a headband that prevents sweat and perspiration fluids from getting in one's eyes, is moisture resistance and does not become saturated, is simple to place and adjust to a user's head, incorporates light weight material, hygienic, and can be further customized to a user's liking.

BRIEF SUMMARY

The disclosure described herein overcomes the above-mentioned shortfalls of prior attempted methods and devices. In particular, in one aspect of the disclosure described herein, a method, and apparatus are provided for perspiration diverting headband that can divert perspiration away from a user's forehead (frontal region) to the side or temporal regions and/or off the user's forehead. In addition, the headband of the disclosure described herein is simple to use and adjust, simple to manufacture, made of light weight moisture resistant and anti-microbial material, hygienic, and can be customized and configured to any shape, color, or design.

In another aspect of the disclosure described herein, a perspiration diverting headband is provided having a flexible tubing having a first and second end, an elastic band, wherein the band is disposed within the tubing, a first connector coupled to the first end of the tubing, and a second connector coupled to the second end of the tubing, wherein the first and second connector secure the elastic band and tubing, and a slidable tension fastener configured to secure the elastic band. In addition, the tubing can be a flexible tubing that is cylindrical. Further, the flexible tubing can be configured to divert perspiration fluids away from a forehead region to a temple region of a user's head. The slidable tension fastener can receive the first and second end of the elastic band. Further, the first and second connector further comprise a first and second region, wherein the elastic band is secured in a second region and wherein the band can slide with respect to the second region.

In another aspect of the disclosure described herein, a perspiration diverting headband is provided having a flexible tubing having a first and second end, an elastic band having a first end and second end, wherein the band is disposed within the tubing. In addition, a first connector coupled to the first end of the tubing, and a second connector coupled to the second end of the tubing, wherein the first and second connector secure the elastic band and tubing. Further, a first slidable fastener can be secured to the first end of the elastic band and configured to slide with respect to the second end of the elastic band, and a second slidable fastener can be secured to the second end of the elastic band and configured to slide with respect to the first end of the elastic band. Also, the flexible tubing can be cylindrical in shape. Further, the flexible tubing can be configured to divert perspiration fluids away from a forehead region to a temple region of a user's head. The slidable tension fastener can receive a first and second end of the elastic band. The first and second connector further includes a first and second region, wherein the elastic band is secured in a second region and wherein the band can slide with respect to the second region.

In another aspect of the disclosure described herein, a method for diverting perspiration fluids is provided. The method can include securing a headband around a user's head, wherein a tubular part at least partially covers the user's forehead region, receiving perspiration fluids from the user's forehead region on the tubular part, and diverting the perspiration fluid along tubular part and away from the forehead region. In addition, the perspiration fluid can be received within a crevice between a surface of the tubular part and a surface of the forehead region of the user. Also, the perspiration fluid can be further guided to the temple region of the user.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

Figure 1:
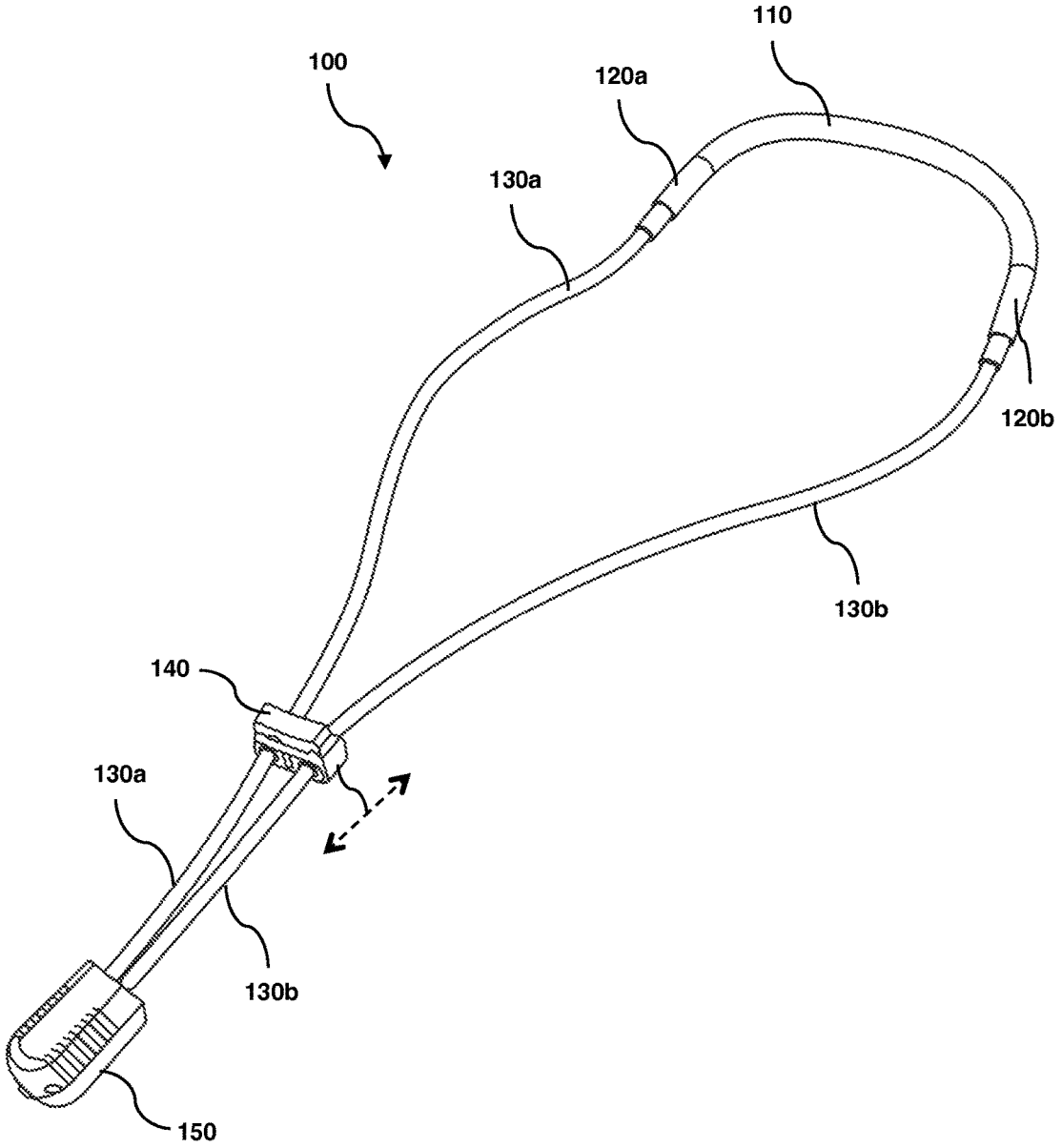
FIG. 1 illustrates a perspective top view of one non-limiting embodiment for the headband of the disclosure described herein.

In the Brief Summary of the present disclosure above and in the Detailed Description of the Disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

FIGS. 1-4 illustrate various views of the headband of the disclosure described herein according to one non-limiting embodiment. Specifically, headband 100 includes a moisture resistance brow flexible cylindrical tubing 110 connected at its ends to elastic flexible cylindrical rubber fasteners 120*a* and 120*b*, wherein fasteners or connectors 120*a* and 120*b* further couple and connect tubing 110 to elastic band 130*a* and 130*b*. In this embodiment, bands 130*a* and 130*b* are one unitary piece, wherein the bands 130*a* and 130*b* run through an interior hollow channel of tubing 110 and terminate at terminator end 150. However, in other embodiments, bands 130*a* and 130*b* can be two separate pieces, wherein the band does not run through the tube 110, wherein tubing 110 can be a solid non-hollow piece, and connect to tubing 110 at fasteners 120*a* and 120*b*. Referring back to the current embodiment, band portions 130*a* and 130*b* are further connected to sliding tensioner fastener 140. Here, fastener 140 allows bands 130*a* and 130*b* to securely fit around a user's head and secure the headband in place, as shown in FIGS. 3 and 4A-4D. Finally, terminator end 150 allows the ends of bands 130*a* and 130*b* to fit securely therein, thereby preventing the ends to hang freely and further preventing fastener 140 for sliding off of bands 130*a* and 130*b*. Here, tensioner fastener 140 can be adjusted along band 130*a* and 130*b* by depressing a top button thereby releasing and disengaging its tension on bands 130*a* and 130*b* and further releasing the button which will again re-engage bands 130*a* and 130*b*.

Figure 2:
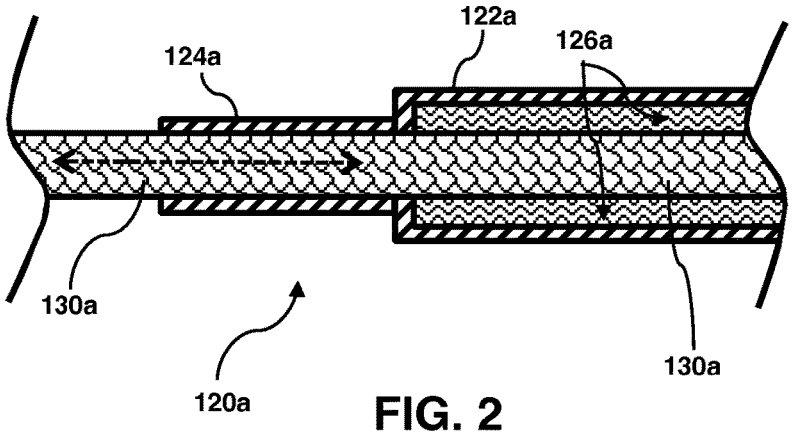
FIG. 2 illustrates a cross sectional side view of a connector and band for the headband of the disclosure described herein.

Referring now to FIG. 2, a cross-sectional side view of connector 120*a* is shown, wherein the connectors 120*b* will have an identical structure. More specifically, connector 120*a* has a first region 122*a* and a second region 124*a*, wherein region 122*a* has a larger diameter than region 124*a*. Here, adhesives 126*a* are used within region 122*a* to secure and connect band 130*a* (and also band 130*b*) to the connector 120*a*, thereby also securing tubing 110 (not shown) and preventing tubing 110 from sliding with respect to either of bands 130*a* and 130*b*. In contrast, band 130*a* can slide and expand within region 124*a*, where it is not fixed, which can allow the band to stretch more and be more expandable and flexible.

Figure 3A:
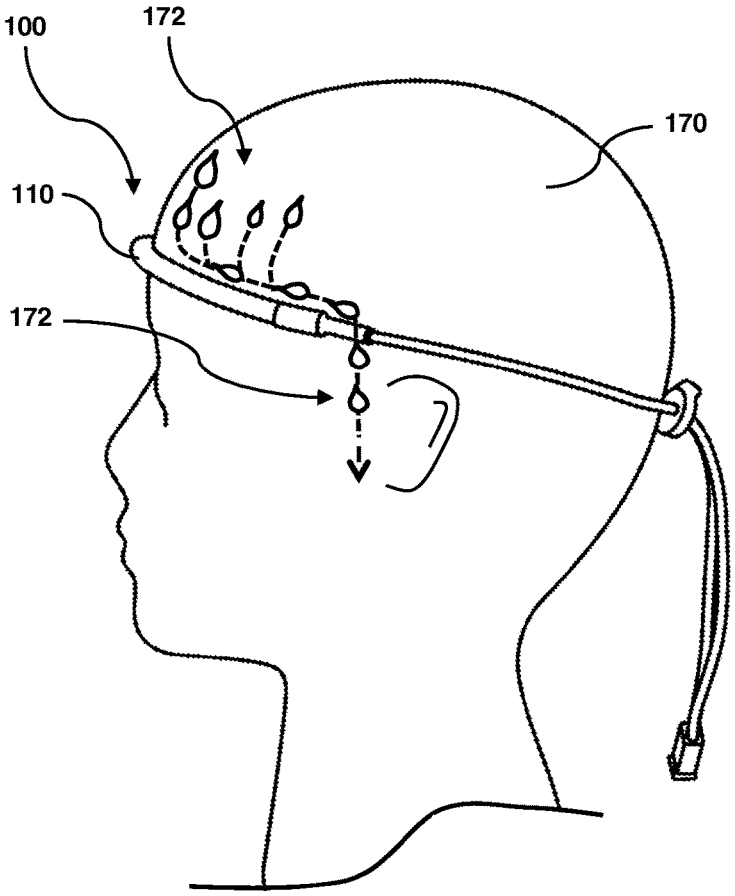
FIG. 3A illustrates a perspective side view of the headband and a user, further illustrating the headband diverting perspiration fluids away from the forehead region of the user.
Figure 3B:
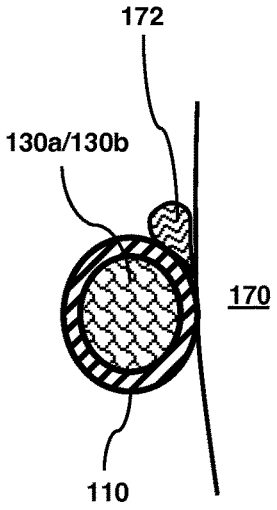
FIG. 3B illustrates a cross-section side view of the headband and the user's forehead, further illustrating headband diverting perspiration fluids away from the forehead region of the user.
Figure 4A:
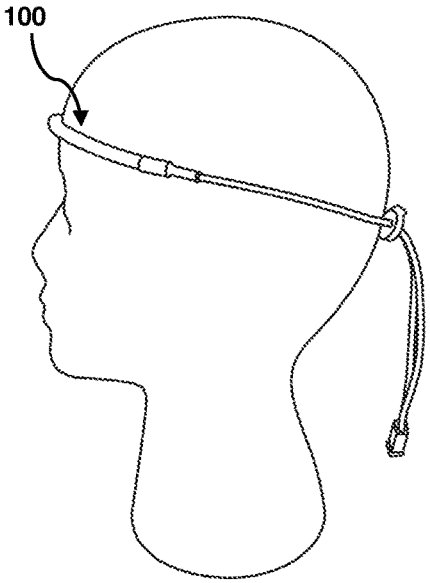
FIG. 4A illustrates a perspective left side view of the headband of the disclosure described herein, as worn by a user.
Figure 4B:
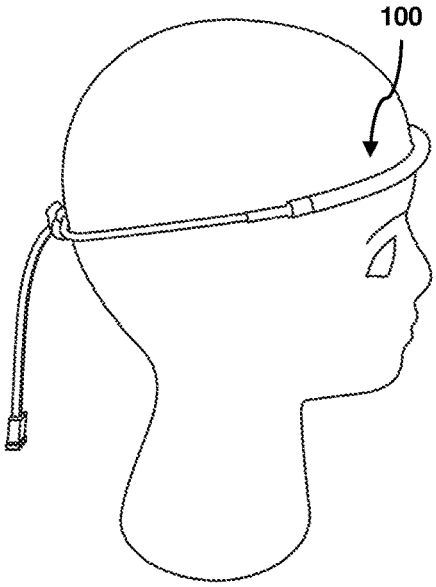
FIG. 4B illustrates a perspective right side view of the headband of the disclosure described herein, as worn by a user.
Figure 4C:
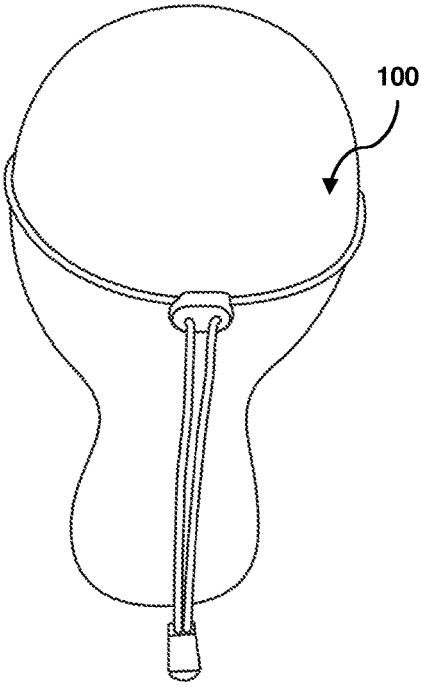
FIG. 4C illustrates a perspective rear view of the headband of the disclosure described herein, as worn by a user.
Figure 4D:
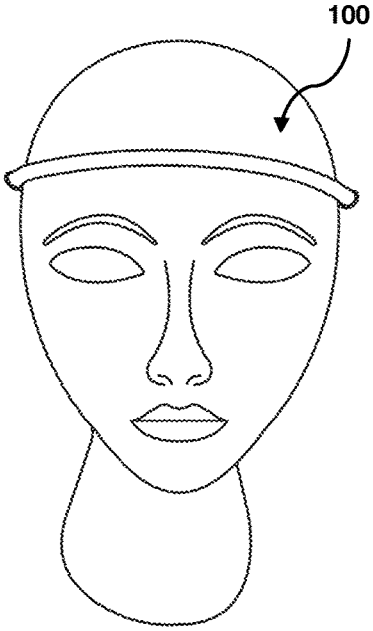
FIG. 4D illustrates a perspective front view of the headband of the disclosure described herein, as worn by a user.

Referring now to FIGS. 3A and 3B, tubing 110 can be a moisture resistant flexible and elastics material that provides a barrier against sweat and perspiration on the forehead of a user. For example, if a user 170 is perspiring sweat beads or perspiration fluid 172 around the forehead (frontal) regions, and the user's head is positioned upright or slightly tilted backwards, then the headband tubing 110 can divert the perspiration fluid 172 from the forehead (frontal region) to and around the side and temporal regions of the head and off of the user's head, as shown in FIGS. 3A and 3B. Alternatively, if the user's head is slightly tilted forward, then the perspiration fluid can flow over the tubing 110 and off the head, preventing the perspiration fluid from falling in the user's eyes. FIG. 3B illustrates a partial cross-section of the tubing 110, having bands 130*a*/130*b* therein, wherein the cylindrical tubing can create a crevice between the surface of the user's forehead and surface of the tubing, and wherein the perspiration fluid 172 can be guided along the crevice and subsequently off of the tubing.

Figure 5:
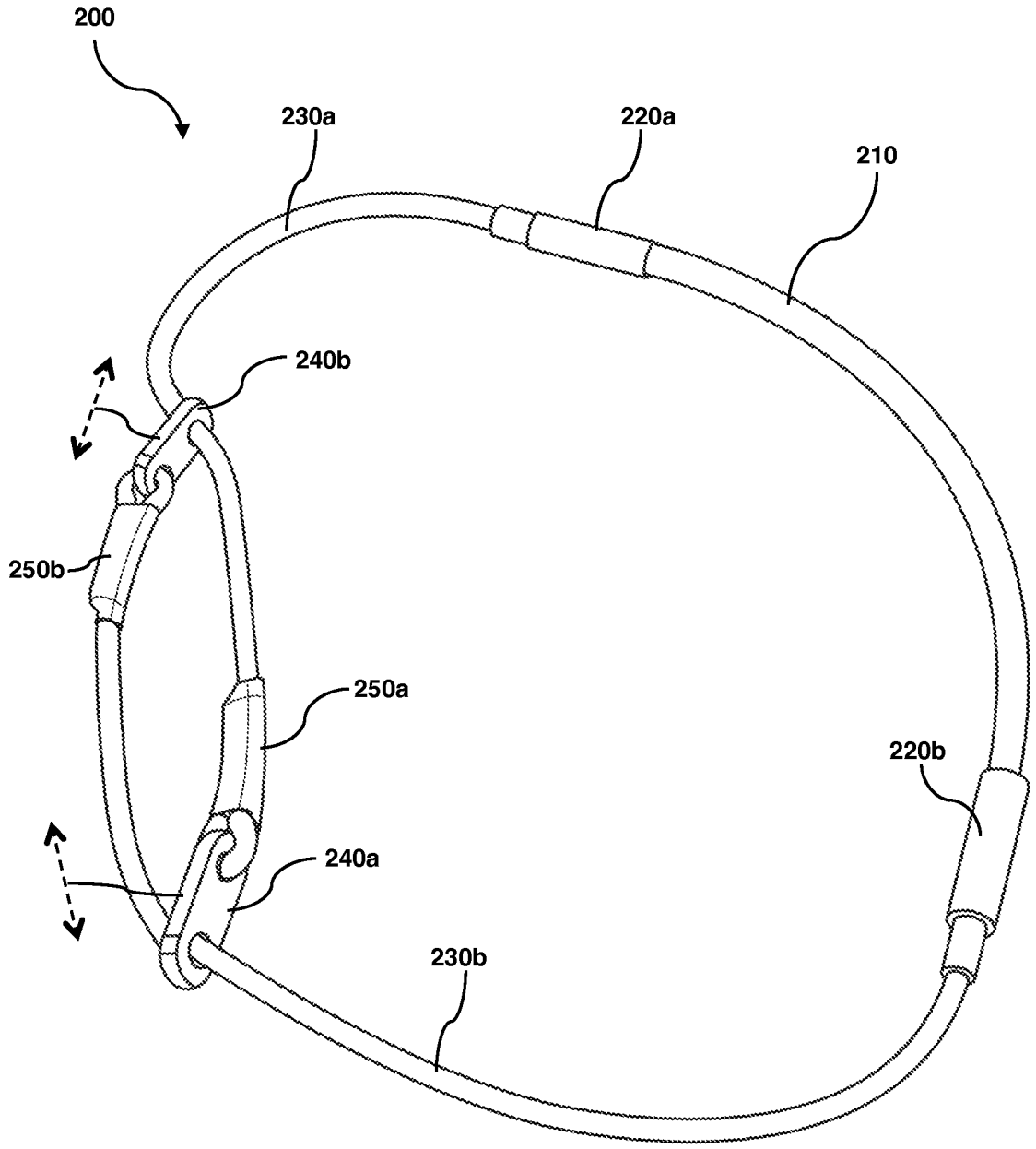
FIG. 5 illustrates a perspective top view of another non-limiting embodiment for the headband of the disclosure described herein.

FIG. 5 illustrates another embodiment for the perspiration diverting brow headband of the disclosure described herein. Specifically, headband 200 includes a moisture resistance tubing 210 connected at its ends to elastic rubber fasteners 220*a* and 220*b*, wherein fasteners or connectors 220*a* and 220*b* further couple and connect tubing 210 to elastic band 230*a* and 230*b*. In this embodiment, bands 230*a* and 230*b* are one unitary piece, wherein the bands 230*a* and 230*b* run through an interior hollow channel of tubing 210 and terminate at terminator ends 250*a* and 250*b*. However, in other embodiments, bands 230*a* and 230*b* can be two separate pieces, wherein the band does not run through the tube 210, wherein tubing 210 can be a solid non-hollow piece, and connect to tubing 210 at fasteners 220*a* and 220*b*. Referring back to the current embodiment, bands portions 230*a* and 230*b* are further connected and looped through an opening of sliding fasteners 240*a* and 240*b*, respectively. Terminator ends 250*a* and 250*b* allow the ends of bands 230*a* and 230*b*, that have been lopped through fastener's 240*a* and 240*b*, to be secured and tightened in place, thereby preventing the ends of bands 230*a* and 230*b* to hang freely and further preventing fasteners 240*a* and 240*b* for sliding off of bands 130*a* and 130*b*.

Still referring to FIG. 5, fastener 240*a* and 240*b* can be slid and adjusted with respect to bands 230*a* and 120*b* to securely fit around a user's head and secure the headband in place. More specifically, fastener 240*a* can receive band 230*b* through an opening and slide with respect to band 230*b*, and fastener 240*b* can receive band 230*a* and slide with respect to band 230*a*. The sliding of either of fasteners 240*a* and 240*b*, or both, can allow the user configure the correct size of the band for placement on his or her head. Once the headband 200 is placed around the user's head, the tension in the bands and the rubber fasteners 240*a* and 240*b*, including friction, prevent slippage or sliding of the fasteners along either of bands 230*a* and 230*b*.

It is contemplated within the scope of the disclosure described herein that bands 130*a*, 130*b*, 230*a*, and 230*b* can be stretchable, flexible, and elastic. However, it is contemplated within the scope of the disclosure described herein that band 130 can also be of non-elastic type and be made of any suitable material. Further, fasteners 140, 240*a*, and 240*b* can be any type of fastener that allows the bands 130*a* and 130*b* to securely fit around the user's head. For example, fasteners 140, 240*a*, and 240*b* can also be a biased or spring biased based tensioner having a button. Here, when the button is depressed the tension is released on the band and the fastener can slide along the band, and when the button is released the fastener can be locked or secured in place. In addition, fasteners 140, 240*a*, and 240*b* can be any type of strap, buckle, cam, clasp, button, or hook and loop material (Velcro®). In addition, fastener 140, 240*a*, and 240*b* can include but is not limited to cotton based materials, polymer based materials, elastic material, rubber material, polymer based, metal cam straps, plastic cam buckle straps, camera straps, D-ring, double D-ring straps, flat hook straps, wire hook straps, loop straps, ratchet straps, side release buckle straps, simple sling straps, strap adjuster straps, D-ring belts, side release buckle belts, double three bar slide belts, and/or double o-ring belts.

Here, tubing 110, 210, bands 130*a*, 130*b*, 230*a*, and 230*b* can be hollow or solid and have a cross-section that is cylindrical, circular, rectangular, or square, or any polygon having three or more sides. Further, tubing 110, 210, bands 130*a*, 130*b*, 230*a*, and 230*b* can be made of materials including but not limited to: moisture and liquid resistant materials, low moisture absorbing materials, heat activated materials, moisture and liquid activated materials, anti-microbial and/or anti-bacterial materials, waterproof materials, moisture resistant fabric/mesh/rubber, polyester based materials, cotton based materials, rubber based materials, neoprene rubber, foam based, plastic based materials, poly based materials, padding, gel based, polymer based, elastic material, viscoelastic material, Gore-Tex®, silicone rubber rolls, commercial silicone, high temperature silicone, cloth silicone, FDA silicone, transparent silicone, translucent silicone, silicone ZZR-765 Rubber, NSF 51 compliant silicone, neoprene rubber, EPDM rubber, Nitrile (Buna-N) rubber, natural gum rubber, Viton® rubber, hypalon rubber, SBR rubber, butyl rubber, latex rubber, santoprene rubber, skirtboard rubber, elastomer, rubber, natural rubber, fillers, additive fillers, epoxy derived, synthetic rubber, polymer, polyurethane, polycarbonate, or any one or more combination of the aforementioned materials. In addition, tubing 110 and band 130 can be of any color code and have any type of indicia, such as text, graphics, images, and artwork.

It is contemplated within the scope of the disclosure described herein that the headband can be used in any type of industry and for any type of application, including but not limited to athletics, sports, recreational, retail, medical, home, or commercial uses. In addition, any of the of the headband or aforementioned parts and components, including but not limited to the tubing, band, and fasteners can be customized and personalized and be configured to be of any shape/design/dimension having any color/artwork or indicia and can be transparent, semi-transparent, or opaque.

Having thus described the several embodiments of the disclosure described herein, those of skill in the art will readily appreciate that other embodiments may be made and used which fall within the scope of the claims attached hereto. Numerous advantages of the disclosure described herein covered by this document have been set forth in the foregoing description. It will be understood that this disclosure is, in many respects, only illustrative. Changes can be made with respect to various elements described herein without exceeding the scope of the disclosure described herein. Although the present disclosure described herein has been described in considerable detail with reference to certain preferred versions or embodiments thereof, other versions and embodiments are possible.

What is claimed is:

1. A perspiration diverting headband, comprising:

a flexible tubing having a first end and a second end;

an elastic band, wherein the elastic band is disposed within the tubing from the first end to the second end, and wherein the elastic band extends through and out the first and second ends;

a first tubular connector secured to the first end of the tubing and at least partially disposed over the elastic band and having a length that extends longitudinally relative to the elastic band, wherein the elastic band further extends through and out the first tubular connector, and the elastic band configured to at least partially slide within and relative to the first connector;

a second tubular connector secured to the second end of the tubing and at least partially disposed over the elastic band and having a length that extends longitudinally relative to the elastic band, wherein the elastic band further extends through and out the second tubular connector, and the elastic band configured to at least partially slide within and relative to the second connector;

wherein the first and second connector secure the elastic band and tubing; and a slidable tension fastener configured to secure the elastic band around a user's head, the slidable tension fastener configured to engage and disengage the elastic band; and an end piece configured to secure one or more ends of the elastic band.

2. The perspiration diverting headband of claim 1, wherein the flexible tubing is cylindrical.

3. The perspiration diverting headband of claim 1, wherein the flexible tubing is configured to divert perspiration fluids away from a forehead region to a side region of a user's head.

4. The perspiration diverting headband of claim 1, wherein the slidable tension fastener receives the ends of the elastic band.

5. The perspiration diverting headband of claim 1, wherein the first and second connector further comprise a first region and a second region, wherein the elastic band is secured in the second region and wherein the elastic band is configured to slide with respect to the second region.

6. A perspiration diverting headband, comprising: a flexible tubing having a first end and a second end; an elastic band, wherein the elastic band is disposed within the tubing from the first end to the second end; a first tubular connector coupled to the first end of the tubing, wherein the elastic band further extends through and out the first tubular connector; a second tubular connector coupled to the second end of the tubing, wherein the first and second tubular connector secure the elastic band and tubing, wherein the elastic band further extends through and out the second tubular connector; and a fastener configured to secure the elastic band around a user's head.

* * * * *